US009347195B2

(12) United States Patent
Whitty, Sr.

(10) Patent No.: US 9,347,195 B2
(45) Date of Patent: May 24, 2016

(54) SYSTEM AND METHOD FOR SPLICING PRECAST PRE-STRESSED CONCRETE PILES

(71) Applicant: Henry Whitty, Sr., Slidell, LA (US)

(72) Inventor: Henry Whitty, Sr., Slidell, LA (US)

( * ) Notice: Subject to any disclaimer, the term of this patent is extended or adjusted under 35 U.S.C. 154(b) by 0 days.

(21) Appl. No.: 14/291,727

(22) Filed: May 30, 2014

(65) Prior Publication Data

US 2014/0270981 A1 Sep. 18, 2014

Related U.S. Application Data

(63) Continuation-in-part of application No. 13/768,470, filed on Feb. 15, 2013, now abandoned.

(51) Int. Cl.
*E02D 27/12* (2006.01)

(52) U.S. Cl.
CPC ..... *E02D 27/12* (2013.01)

(58) Field of Classification Search
CPC ..... E02D 5/523; E02D 5/526
USPC ..... 405/231, 232, 251, 252
See application file for complete search history.

(56) References Cited

U.S. PATENT DOCUMENTS

| | | | | | |
|---|---|---|---|---|---|
| 3,650,553 | A | * | 3/1972 | Wennstrom | 403/282 |
| 4,009,550 | A | * | 3/1977 | Young | 405/251 |
| 4,050,211 | A | * | 9/1977 | Wahman | 405/251 |
| 4,460,201 | A | * | 7/1984 | McGugan | 285/18 |
| 4,604,003 | A | * | 8/1986 | Francoeur et al. | 405/256 |
| 4,605,340 | A | * | 8/1986 | Stephan | 405/252 |
| 4,900,193 | A | * | 2/1990 | MacKinnon | 405/252 |

OTHER PUBLICATIONS

"Methods of Prestressing in Concrete" powerpoint https://gees7.files.wordpress.com/2011/02/prestressed-concrete.ppt.*

* cited by examiner

*Primary Examiner* — Thomas B Will
*Assistant Examiner* — Katherine Chu

(57) ABSTRACT

A system and method for splicing precast pre-stressed concrete piles and bringing pre-stress forces to each end of the piles with splice plates and with sockets cast in the splice plates to receive pre stressing strands, strand wedges to engage the strands in the sockets and transfer the pre stress forces to the ends of the piles after re-stressing, with alignment pins, alignment sockets and connecting channels to join splice plates.

6 Claims, 8 Drawing Sheets

SYSTEM AND METHOD FOR SPLICING PRECAST PRE-STRESSED CONCRETE PILES

This application is a Continuation-in-part of application Ser. No. 13/768,470 (the '470 application') filed Feb. 15, 2013. The '470 application is incorporated here by reference.

BACKGROUND OF THE INVENTION

Precast pre-stressed concrete piles are used in the construction of foundations for buildings, bridges, wharfs, docks and other structures. Concrete pile lengths are limited by the lengths that can be shipped to the construction site and lifted by the pile driving machine. In many cases to develop the needed bearing capacity the pile lengths are greater than what can be shipped and handled by the pile driving machine. In order to achieve the required length precast concrete piles are driven as spliced segments. The International Building Code requires the splice to develop a minimum of 50% of the un-spliced pile capacity in moment (bending) and tension.

Concrete has large compressive strength, but little tensile strength. The tensile strength governs the moment or bending capacity of the pile. In order to make the pile rigid enough to handle, ship and lift into the pile driving machine a system of high strength cables or strands is used to develop the needed moment and tensile strength. The number and size of the pre-stressing strands is dependent on the size of the pile.

Currently there are several splices available in the market. Most of these splices consist of a splice plate on the adjoining ends of the pile segments to be spliced. These plates are attached to the ends of the pile segments with reinforcing steel welded to the plates and protruding into the concrete of the pile segments. These plates are mechanically joined by systems of wedges, pins, and other mechanical means.

As concrete has little tensile strength the pre-stressing strands are necessary to develop tensile strength required for moment or bending stresses, and for tension loads. The pre-stressing operation uses abutment at both ends of pile forms. At one end the strand is held with strand chucks and at the other end a calibrated hydraulic jack is used to stress the strand. After the strands are stressed (pulled) the concrete is placed in the pile forms. When the concrete has reached a specified strength the strands are released from the abutments and the pre-stress forces are released into the concrete pile. The bond between the concrete and the strand requires a developmental length of some significant length. Because of this the ends of the concrete pile segments have little or no pre-stress force. Due to this lack of pre-stress force in the ends of the joined segments of the pile, the spliced pile does not develop any moment or tension at the splice. To address this, additional reinforcing steel is added to the ends of the pile segments to the joined.

SUMMARY OF THE INVENTION

The inventive system and method is designed to address these problems by connecting the pre-stressing strands with a strand splice chuck, thus making the pre-stressing strand a continuous element through the length of the spliced pile and at the same time bring the pre-stress forces to the end of the pile. No previously available pile splice can accomplish this.

In order to accomplish continuous pre-stressing forces through the ends of the pile segments an arrangement of strand chucks must be attached to the strands. This will be near the extreme ends of the pile segment and placed prior to de-tensioning the strands. This will result in little or no loss of the pre-stressing forces required for the bond between the strand and the concrete.

Splice Plates with strand chuck sockets cast in the plates in a pattern matching the strand pattern of the pile segments to be spliced are to be attached to the top end of the bottom section, and to the bottom end of the top section. These plates will be placed into the forms with the strand in the sockets prior to prior to the stressing of the strands and pouring of the concrete.

As the pile segments are cast in a long continuous mold (form) the pile segments are separated in the proper lengths by bulkheads in the form. The pre-stressing strands are placed in the forms and through the bulkheads for the entire length of the form. Light gage spiral reinforcing steel is placed around the strand like hops on a barrel. The pre-stressing strands are then stretched (stressed) to a specific load by a calibrated hydraulic jack. Once the concrete is poured and has reached a specific strength the pre-stressing strands are cut between each pile segment allowing the pre-stressing forces to be applied to the concrete pile.

The concept of the present invention is to connect the splice plates to the pile with the pre-stress strands and at the same time bring the pre-stress forces to the end of the pile.

As noted above there is a development length in the concrete needed to form a bond between the concrete and the strand. For the commonly used ½ inch 7 wire 270 kip strand this developmental length is about 84 inches. Therefore there is no force at the end of the pile. The bond is increasing and the pre-stress forces along this 84 inches likewise increases to where at the $84^{th}$ inch the full force is developed.

Prototype testing has confirmed that it takes about ½ inch to ⅜ inch strand movement for strand chuck wedges to fully engage. Using the formula for calculating the elongation of the strand under stress (D=PL/AE) where the D (elongation) =P (loads applied in pounds)×L (length of strand) divided by A (cross section of the strand)×E (modulus of elasticity) we find that in the 84 inch developmental area the elongation is 0.295 inches. (D=30000 lb×42 in)/(0.152 in Square×30,000,000)

With the ½ inch movement the pre-stress force is lost at the end of the pile and the splice plates under a tension load pulls away from the concrete.

To overcome this loss of most if not all the pre-stress forces at the end of the pile, under the present invention the ends of the strand are re-stressed with a post tensioning jack after the piles have been removed from the forms. As an example, to assure that there is sufficient movement in the strand to be fully engaged by the strand chuck wedges, a 12 foot length of the strand at the pile ends will be coated with a bond breaker so the strand and the concrete will not bond. With half of the 84 inch developmental length we will have a total of 186 inches of strand to re-stress. Again using D=PL/AE we find that there will be about 1.305 inches of elongation of the strand. Subtracting the 0.250 inch needed to set the wedges we will have 1.055 inches of elongation remaining. Again using D=PL/AE we can now solve for L, the remaining load (stress) of the strand. (1.055=(P×186)/(0.154×30,000,000) or 25,865 pounds.

In order to meet the International Building Code we need to develop 50% of the un-spliced pile capacity in moment and tension. The American Concrete Institute tells us that in a precast pre-stress concrete pile the tension capacity is equal to the net pre-stress force in the pile. Using the recommendations of the Precast Concrete Institute recommendations the net pre-stress force is only about 85% of the initial pre-stress forces after accounting for slippage, relaxation and other factors. As the ½ inch strand is pulled to 32,000 pounds 85% net pre-stress force would be 27,200 pounds. We need to achieve 50% of this or 13,600 pounds. With the 25,865 pounds achieved with the post tensioning we exceed this requirement. As moment is a function of the tensile strength we will also exceed the moment requirement.

When installing (driving) the pile, the first (lower) segment is driven such that the portion to be joined with the second (upper) segment is up. Driving is stopped when the top of the lower segment is several feet above the ground. The top segment is then placed on top of the lower segment with aligning pins in the corner of the two splice plates to align the two segments, and these pins also address any horizontal shear that might be applied in the driving of the pile. In placing the concrete a groove is formed at the edge of the splice plate to receive a connecting steel channel which joins the two splice plates and thus the pile segments.

It is an object of this invention to provide a system and method for splicing precast pre-stressed concrete piles such that the splice will develop a minimum of 50% of the unspliced pile capacity in moment (bending) and tension.

DETAILED DESCRIPTION OF THE INVENTION

Figure 1:
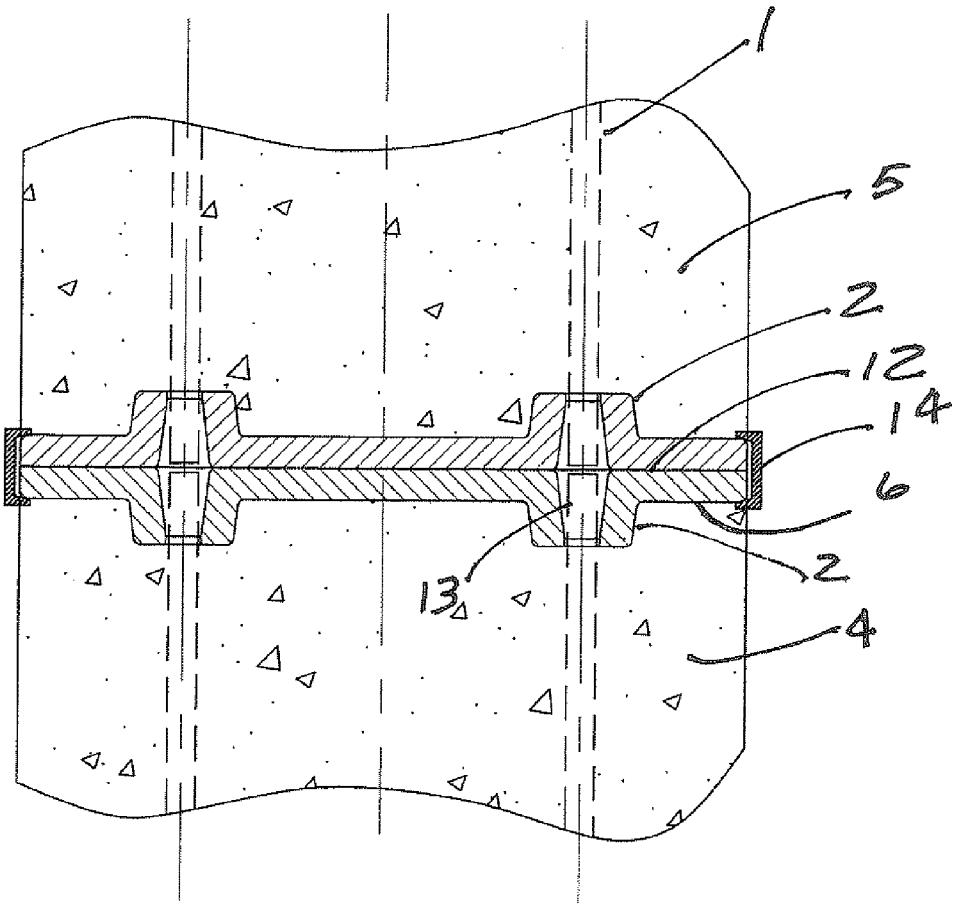
FIG. 1 is a cross section view of the assembled splice.
Figure 2:
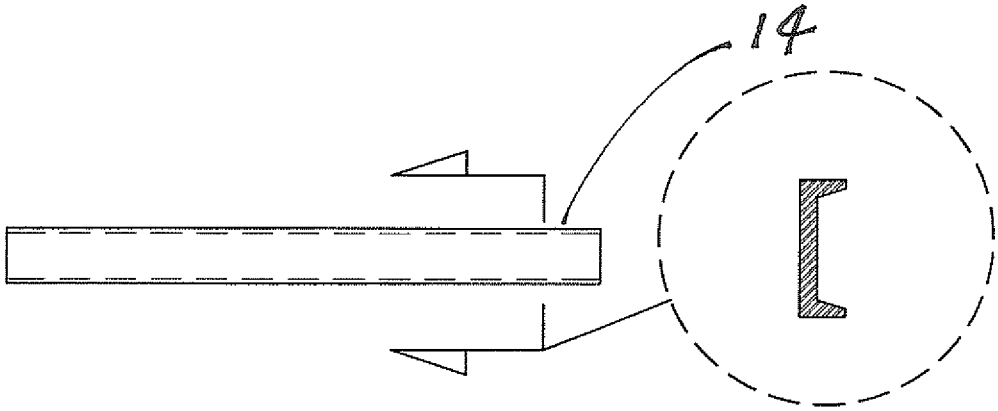
FIG. 2 is a view of the connecting channel.
Figure 3:
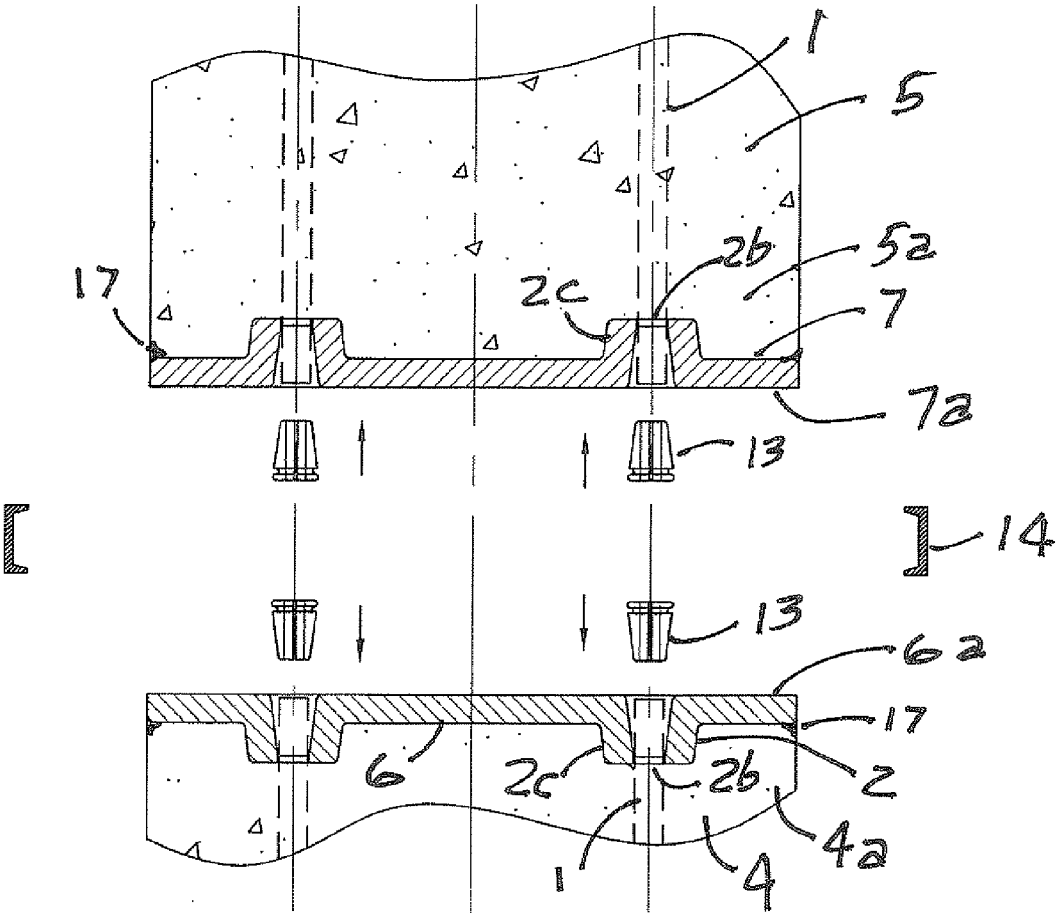
FIG. 3 is an exploded cross section view of the splice components before splicing.

FIG. 1 is a cross section view of an assembled splice of two typical precast pre-stressed piles and FIG. 3 shows an exploded cross section of the ends of typical precast pre-stressed piles before splicing each having an upper end 4 and a lower end 5 with an upper end splice plate 6 and a lower end splice plate 7 and strand chuck sockets 2 of such number and location to match the number and location for each of the pre-stressing strands 1 with upper and lower ends, running respectively from the upper end to the lower end of the precast pre-stressed pile. It is understood that the depiction of FIGS. 1 and 3 are typical for both the upper and lower ends of precast pre-stressed piles, and would be repeated on any other precast pre-stressed pile intended to be spliced to one below it. Also shown is a connecting channel 14 set in a groove 17 to encase and connect the splice plates 6 and 7. The connecting channel 14 is also depicted in FIG. 2.

Figure 8:
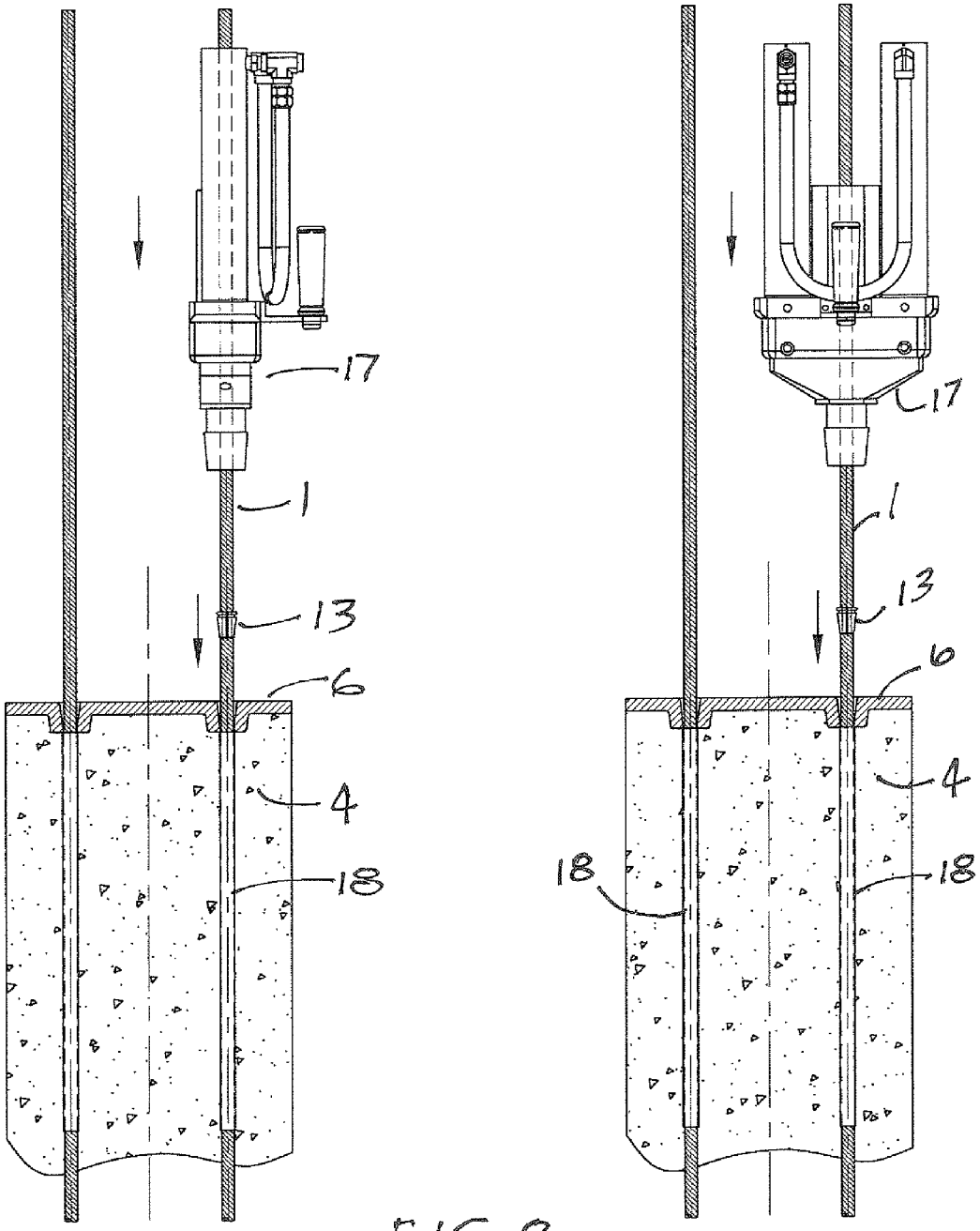
FIG. 8 is a cross sectional view of a pile end after removal from a form with the pre-stressing strands being re-stressed by a post tensioning jack.

Beginning at the upper end and the lower end of the precast pre-stressed pile each end of the pre-stressing strand 1 will be coated with a bond breaker 18 as shown in FIG. 8 for a length sufficient to prevent bonding between the strand 1 and concrete in the pile.

Figure 5:
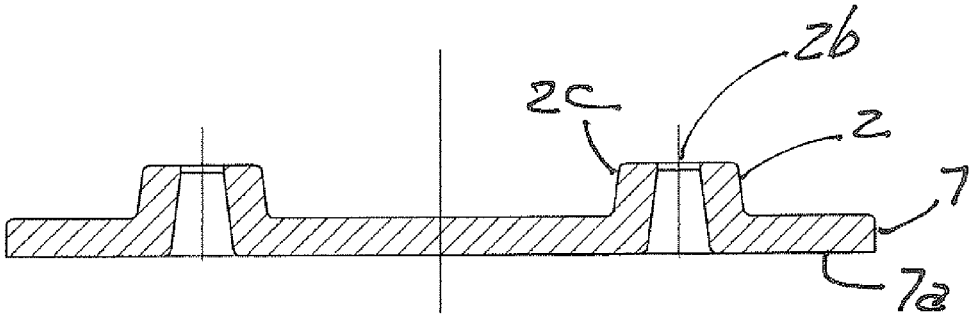
FIG. 5 is a cross section view of the splice plates through arrows 5-5 with the strand chuck sockets.
Figure 6:
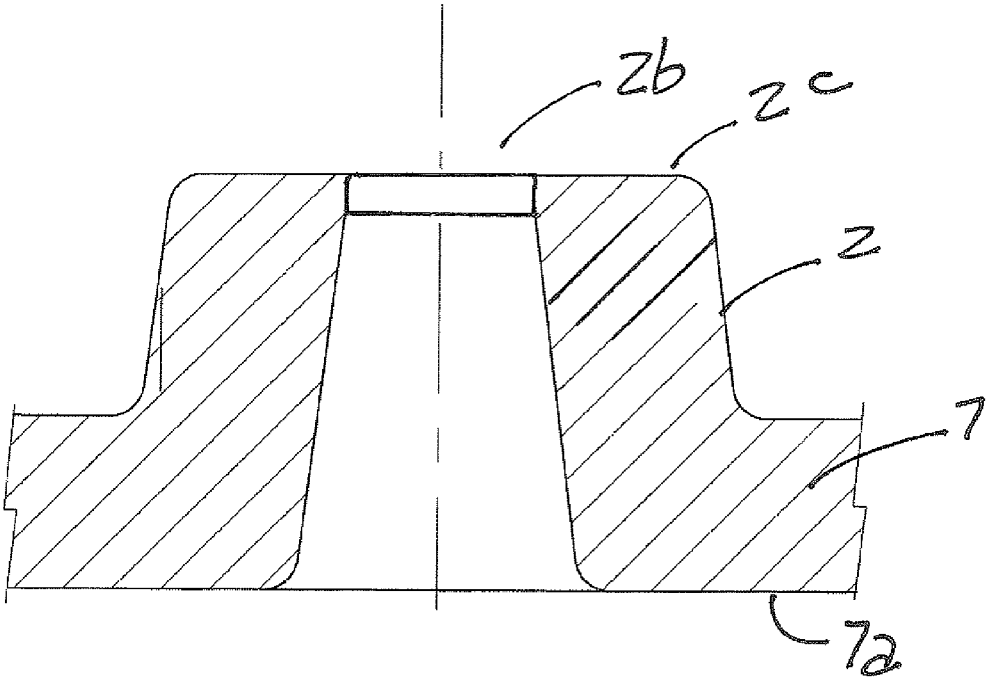
FIG. 6 is a detail of the strand chuck socket.

FIG. 3 shows an exploded cross section of the ends of typical precast pre-stressed piles before splicing with an upper pile 5 above a lower pile 4, each pile having an upper and a lower end. In this depiction, the lower end 5*a* of pile 5 is opposite the upper end 4*a* of the lower pile 4. On the lower end 5*a* and the upper end 4*a* are lower end splice plate 7 and a upper end splice plate 6 respectively with strand chuck sockets 2 placed to align with the pre-stressing strands 1 that extend through a hole 2*b* in the socket ends 2*c* and protrude into the strand chuck socket 2. This is further depicted in FIGS. 5 and 6. On the lower end 5*a* of pile 5 is an end splice plate 7 with an exposed face 7*a*. On the upper end 4*a* of pile 4 is an end splice plate 6 with an exposed face 6*a*. It is intended that when pile 4 is spliced to pile 5, exposed face 7*a* will be in full contact with exposed face 6*a* at point 12. Also shown in FIG. 3 are strand chuck wedges 13 for each corresponding strand chuck socket 2 in the upper end splice plate 6 and the lower end splice plate 7. In FIG. 1 a strand chuck wedge 13 is shown in the bottom end 2*c* of the strand chuck socket 2 in place over the protruding end of each of the pre-stressing strands 1 that extend through the hole 2*b* in the socket end 2*c*. As can be seen in FIGS. 1 and 3 each strand chuck wedge 13 is in alignment with one of the pre-stressing strands 1 in the upper pile 5 and the lower pile 4. It is also understood that the end of the pre-stressing strand 1 protruding into the strand chuck socket 2 through the hole 2*b* will be of such length as to receive the strand chuck wedge 13. Likewise, each strand chuck socket 2 must be of such length to receive the strand chuck wedge 13, so as not to prevent exposed face 7*a* from making full contact with exposed face 6*a* when pile 4 is spliced to pile 5.

A typical strand chuck socket 2 as depicted in FIG. 3 has a tapered interior to receive a strand chuck wedge 13. The strand chuck wedge 13 can be split for ease of installation.

The strand chuck wedges 13 are placed on the pre-stressing strands 1 prior to transferring the pre-stressing forces in the pre-cast concrete piles, and once the concrete piles are removed from forms the strands 1 are re-stressed by a post tensioning jack 17 as shown in FIG. 8. This insures that the pre-stress forces are carried to the ends of the piles.

Figure 4:
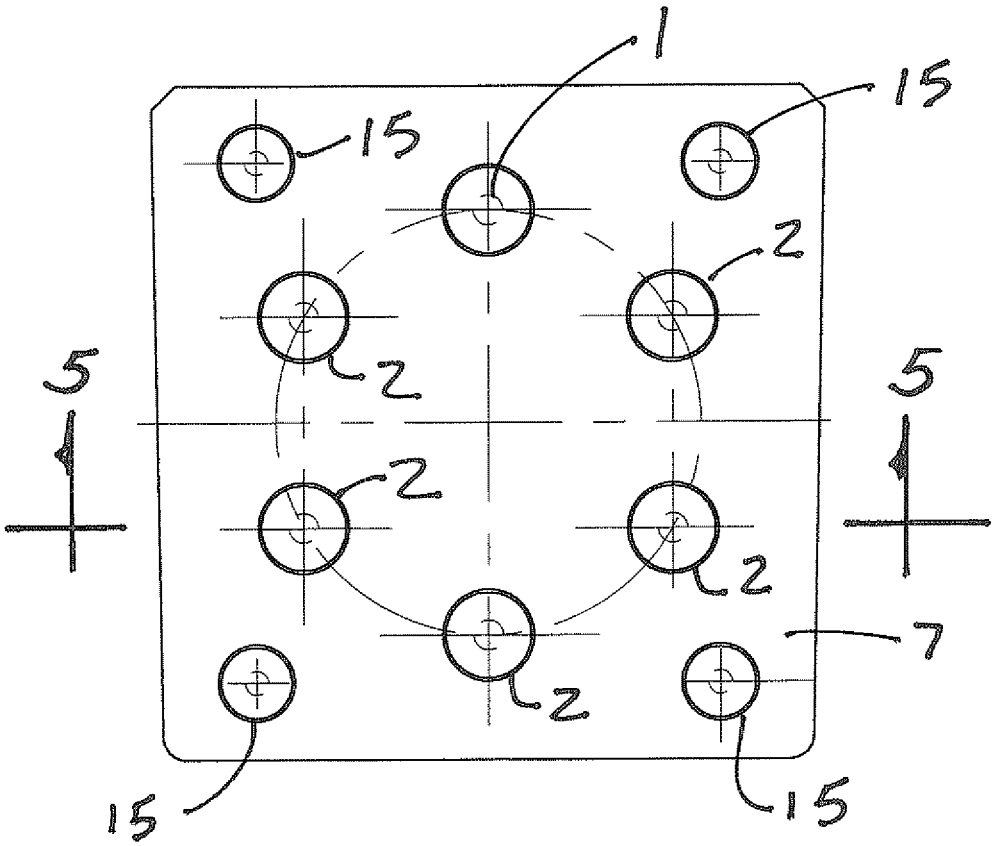
FIG. 4 is a plan view of the splice plates (both the upper end of the lower section and the lower end of the upper section), with the locations of the strand chucks sockets and the aligning pin sockets.
Figure 7:
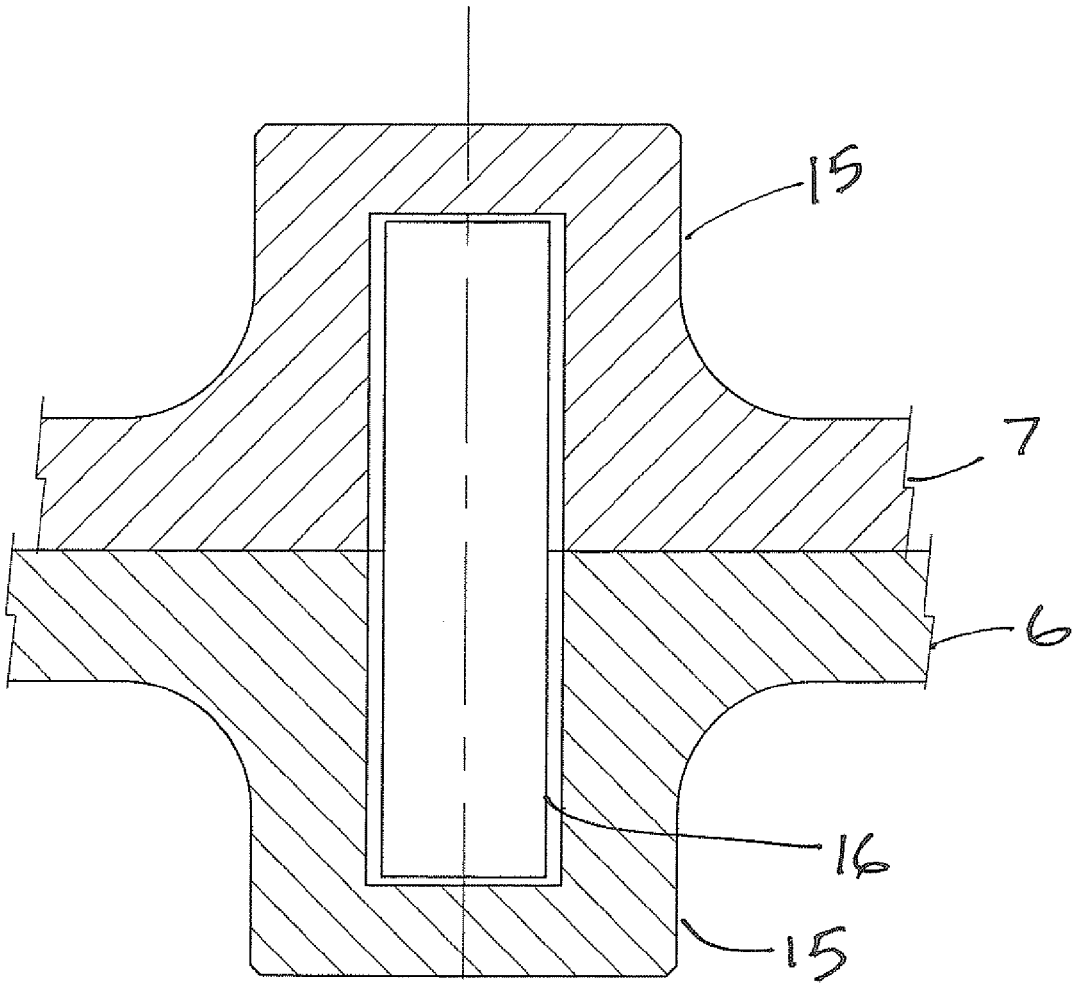
FIG. 7 is a detail view of the alignment pins and alignment pin sockets.

A plan view of the exposed face of the splice plates 6 and 7 is shown in FIG. 4 and, as shown, each strand chuck socket 2 is in line with a pre-stressing strand 1. Also shown are alignment pin sockets 15 in the four corners of the splice plates 6 and 7. As shown in FIG. 7, when the upper pile segment is placed over the lower pile segment alignment pins 16 are placed in the alignment pin sockets 15 located in the four corners of the splice plates. Once the segments are placed and aligned the connecting channels 14 are placed along the edges of the splice plates 6 and 7 joining and securing the pile segments.

FIG. 8 shows two cross sectional views of a pile end 4 after removal from a form with the pre-stressing strands 1 being re-stressed by a post tensioning jack 17 before engagement of the strand chuck wedges 13. Also shown are bond breakers 18 coated on the strand ends to assure that there is sufficient movement in the strand to be fully engaged by the strand chuck wedges 13.

It is an object of this invention to provide a system for splicing precast pre-stressed concrete piles while maintaining the normal pre-stress strand spacing, size and configuration, comprising a plurality of precast pre-stressed concrete piles, each with a pile upper end having a pile upper end slice plate, and a pile lower end having a pile lower end splice plate interchangeable with the pile upper end splice plate and at least one pre-stressing strand having a strand lower end and an strand upper end, each strand end coated with a bond breaker for a length sufficient to prevent bonding between the strand and concrete in the pile to assure that there is sufficient movement in the strand to be fully engaged by the strand chuck wedges, running longitudinally from the pile lower end to the pile upper end, a strand socket at the pile upper end splice plate and pile lower end splice plate each located to receive respectively the strand upper end and the strand lower end, each of said strand sockets having a socket end and hole embedded in the respective pile upper end and pile lower end and the socket terminating and opening at a pile upper or lower end splice plate, the strand lower end and the strand upper end each having a protruding end extending through their respective socket ends and holes, each strand protruding end extending through their respective socket ends and holes in a pre-stressed condition and engaged by strand chuck wedges after re-stressing by post tensioning jack. It is also intended to provide alignment pins in alignment pin sockets cast in the upper and lower end splice plates and to provide a connecting channel to join the pile upper end splice plate and pile lower end splice plate in a spliced condition.

It is a further object of this invention to provide a method for splicing precast pre-stressed concrete piles while maintaining the normal pre-stress strand spacing, size and configuration of a typical un-spliced concrete pile, comprising a plurality of precast pre-stressed concrete piles, each with a pile upper end having a pile upper end slice plate, and a pile lower end having a pile lower end splice plate interchangeable with the pile upper end splice plate and at least one pre-stressing strand having a strand lower end and an strand upper end, each strand end coated with a bond breaker for a length sufficient to prevent bonding between the strand and concrete in the pile to assure that there is sufficient movement in the strand to be fully engaged by the strand chuck wedges, running longitudinally from the pile lower end to the pile upper end, comprising the steps of:

casting a strand socket at the pile upper end splice plate and pile lower end splice plate each located to receive respectively the strand upper end and the strand lower end, each of said strand sockets having a socket end and hole embedded in the respective pile upper end and pile lower end and the socket terminating and opening at a pile upper or lower end splice plate, the strand lower end and the strand upper end each having a protruding end extending through their respective socket ends and holes;

re-stressing by a post tensioning jack and engaging each strand protruding end extending through their respective socket ends and holes in a pre-stressed condition by a strand chuck wedge to carry pre-tension forces to the respective ends of the pile;

lower the pile lower end of a pile above being spliced against the upper end of a pile below being spliced such that the pile upper end splice plate of the pile below engages the pile lower end spice plate of the pile above with alignment pins in alignment pin sockets cast in the upper and lower end splice plates;

join the upper and lower end splice plates with a connecting channel set in grooves around the upper and lower end splice plates.

I claim:

1. A system for splicing precast pre-stressed concrete piles while maintaining the normal pre-stress strand spacing, size and configuration, comprising a plurality of precast pre-stressed concrete piles, each with a pile upper end having a pile upper end splice plate, and a pile lower end having a pile lower end splice plate interchangeable with the pile upper end splice plate and at least one pre-stressing strand having a strand lower end and an strand upper end, each strand end coated with a bond breaker only for a length sufficient to prevent bonding between the strand and concrete in the pile at each respective end to assure that there is sufficient movement in the strand to be fully engaged by strand chuck wedges, running longitudinally from the pile lower end to the pile upper end, a strand socket at the pile upper end splice plate and pile lower end splice plate each located to receive respectively the strand upper end and the strand lower end, each of said strand sockets having a socket end and hole embedded in the respective pile upper end and pile lower end and the socket terminating and opening at a pile upper or lower end splice plate, the strand lower end and the strand upper end each having a protruding end extending through their respective socket ends and holes, each strand protruding end extending through their respective socket ends and holes in a pre-stressed condition and engaged by strand chuck wedges after re-stressing by post tensioning jack.

2. The system of claim 1 further comprising alignment pins in alignment pin sockets cast in the upper and lower end splice plates.

3. The system of claim 2 further comprising connecting channels to join the pile upper end splice plate and pile lower end splice plate in a spliced condition.

4. A method for splicing precast pre-stressed concrete piles while maintaining the normal pre-stress strand spacing, size and configuration of a typical un-spliced concrete pile, comprising a plurality of precast pre-stressed concrete piles, each with a pile upper end having a pile upper end splice plate, and a pile lower end having a pile lower end splice plate interchangeable with the pile upper end splice plate and at least one pre-stressing strand having a strand lower end and an strand upper end, each strand end coated with a bond breaker only for a length sufficient to prevent bonding between the strand and concrete in the pile at each respective end to assure that there is sufficient movement in the strand to be fully engaged by strand chuck wedges, running longitudinally from the pile lower end to the pile upper end, comprising the steps of:

casting a strand socket at the pile upper end splice plate and pile lower end splice plate each located to receive respectively the strand upper end and the strand lower end, each of said strand sockets having a socket end and hole embedded in the respective pile upper end and pile lower end and the socket terminating and opening at a pile upper or lower end splice plate, the strand lower end and the strand upper end each having a protruding end extending through their respective socket ends and holes;

re-stressing and engaging each strand protruding end extending through their respective socket ends and holes in a pre-stressed condition by a strand chuck wedge to carry pre-tension forces to the respective ends of the pile.

5. The method of claim 4 further comprising placement of alignment pins in alignment pin sockets cast in the upper and lower end splice plates.

6. The method of claim 5 further comprising joining the pile upper end splice plate and pile lower end splice plate in a spliced condition with connecting channels.

* * * * *